US008081087B2

(12) United States Patent
Jones

(10) Patent No.: US 8,081,087 B2
(45) Date of Patent: Dec. 20, 2011

(54) FLASHING BEACON

(75) Inventor: Richard D. Jones, Venice, FL (US)

(73) Assignee: R. D. Jones, Stop Experts, Incorporated

( * ) Notice: Subject to any disclaimer, the term of this patent is extended or adjusted under 35 U.S.C. 154(b) by 444 days.

(21) Appl. No.: 12/303,802

(22) PCT Filed: Jun. 6, 2007

(86) PCT No.: PCT/US2007/070494

§ 371 (c)(1),
(2), (4) Date: Dec. 8, 2008

(87) PCT Pub. No.: WO2007/143680

PCT Pub. Date: Dec. 13, 2007

(65) Prior Publication Data

US 2010/0207788 A1 Aug. 19, 2010

Related U.S. Application Data

(60) Provisional application No. 60/811,157, filed on Jun. 6, 2006.

(51) Int. Cl.

| | |
|---|---|
| ***G08G 1/07*** | (2006.01) |
| ***G08G 1/095*** | (2006.01) |
| ***G08G 1/01*** | (2006.01) |
| ***G08B 5/22*** | (2006.01) |
| ***B61L 1/02*** | (2006.01) |
| ***B61L 29/24*** | (2006.01) |

(52) U.S. Cl. ..... 340/907; 340/906; 340/917; 340/925; 340/933; 340/481; 246/125; 246/473.2

(58) Field of Classification Search ..... None
See application file for complete search history.

(56) References Cited

U.S. PATENT DOCUMENTS

| | | | |
|---|---|---|---|
| 1,951,431 | A | 3/1934 | Meehan |
| 2,121,093 | A | 6/1938 | Munch |
| 2,679,635 | A | 5/1954 | Hart |

(Continued)

FOREIGN PATENT DOCUMENTS

| | | |
|---|---|---|
| JP | 2001338777 | 12/2001 |

(Continued)

OTHER PUBLICATIONS

Introducing the lightest and brightest defense systemf or your Crossing Gurads who use signs. The Crosswalk Defender, Archive.org. www.stopexperts.com circa Feb. 8, 2005.

(Continued)

*Primary Examiner* — George Bugg
*Assistant Examiner* — Renee Dorsey
(74) *Attorney, Agent, or Firm* — Gifford, Krass, Sprinkle, Anderson & Citkowski, P.C.

(57) ABSTRACT

A flashing beacon may include a signal unit, a control unit associated with the signal unit, a solar panel or collector, and an activation device that may all be mounted or otherwise positioned on a post of a roadway sign. Light units associated with the signal unit may be programmed to flash on and off in a unique wig-wag pattern. Further, a light bar may also be used with the beacon to generate an intense flash of light soon after activation of the beacon as an additional means of grabbing the attention of the operator of a vehicle.

18 Claims, 8 Drawing Sheets

U.S. PATENT DOCUMENTS

| | | | | |
|---|---|---|---|---|
| 2,902,672 | A | 9/1959 | Hart | |
| 2,965,880 | A | 12/1960 | Hart | |
| 2,967,293 | A | 1/1961 | Paulson | |
| 3,205,478 | A | 9/1965 | Scheg | |
| 3,963,202 | A | 6/1976 | Hopkins | |
| 4,879,545 | A * | 11/1989 | Aguilar | 340/624 |
| 5,023,607 | A | 6/1991 | Staten | |
| 5,103,223 | A | 4/1992 | Humphrey | |
| 5,235,768 | A | 8/1993 | Eder | |
| 5,735,492 | A | 4/1998 | Pace | |
| 6,035,567 | A * | 3/2000 | Cameron | 40/607.04 |
| 6,147,623 | A | 11/2000 | Rippen | |
| 6,384,742 | B1 | 5/2002 | Harrison | |
| 6,879,263 | B2 | 4/2005 | Pederson et al. | |
| 6,963,275 | B2 * | 11/2005 | Smalls | 340/473 |
| 7,019,669 | B1 * | 3/2006 | Carr | 340/906 |
| 7,196,636 | B2 | 3/2007 | Graham | |
| 7,317,405 | B2 | 1/2008 | Green et al. | |
| 2001/0054970 | A1 * | 12/2001 | Jones | 340/915 |
| 2002/0073586 | A1 * | 6/2002 | Backe | 40/612 |
| 2004/0183694 | A1 * | 9/2004 | Bauer | 340/907 |
| 2005/0104747 | A1 | 5/2005 | Silic et al. | |
| 2005/0128105 | A1 * | 6/2005 | Green et al. | 340/944 |
| 2005/0174776 | A1 | 8/2005 | Althaus | |
| 2005/0184883 | A1 * | 8/2005 | Graham | 340/917 |
| 2006/0061487 | A1 * | 3/2006 | Heap | 340/908 |

FOREIGN PATENT DOCUMENTS

| | | |
|---|---|---|
| KR | 20030075226 | 9/2003 |
| KR | 20030089966 | 11/2003 |
| KR | 20040110782 | 12/2004 |

OTHER PUBLICATIONS

Sop Experts, Inc.Crosswalk defender, stopexperts.com circa 2006.
Crosswalk Angel, personal defender, stopexperts.com circa 2006.
Seat Blet Check Angel 8, stopexperts.com circa 2006.

* cited by examiner

FLASHING BEACON

BACKGROUND OF THE INVENTION

1. Field of the Invention

Disclosed herein is a flashing beacon. More specifically, disclosed herein is a flashing beacon that may be positioned on most any roadway sign or signpost, and that may include a signal unit, a control unit, a solar collector, an activation device (e.g., a timer, microwave emitter, radio transmitter, step-pad, a pushbutton, infrared transmitter, wireless transmitter or like device) and various other accessories.

2. Reference to Related Art

According to the U.S. Manual on Uniform Traffic Control Devices, flasher mechanisms associated with traffic control signs (e.g., a yield or crosswalk sign) must be positioned on the sign (or signpost) so that flashing signal is about 12 feet above the pavement. The flashing signal must also be programmed or otherwise set to flash continuously at a rate of not less than 50 nor more than 60 times per minute. See MUTCD, Section 4D.11. However, while the guidelines set forth in the uniform regulations are intended to provide a visible warning to drivers, recent testing has suggested that only a small percentage of the public responds to flashing signals that operate according to the uniform regulations. Specifically, recent testing has suggest that only 25% of the public complies with or otherwise responds to flashing signals associated with roadway signage. Therefore, it would be advantageous to have an improved flashing beacon system that may be used with existing or future roadway signage to garner a greater response from the vehicle driving public.

SUMMARY OF THE INVENTION

About 20 years ago, the public began to demand that the automotive industry manufacture "quiet" cars and trucks—and the industry responded. Indeed, the industry responded so well that the interior of many vehicles have been effectively transformed into moving soundproof rooms. Unfortunately, the "quiet" has sometime resulted in drivers and passengers alike becoming distracted and forgetting that they are in a moving vehicle. For example, it is not uncommon for present day drivers to be seen talking on a cellular phone, reading a paper, listening to satellite stereo systems, being distract by children in the vehicle, applying makeup, using on-board navigation systems, watching a DVD, or just plain not paying attention to the roadway.

Clearly, one thing that is lost or diminished by all these possible distraction is a proper attention to and respect for roadway signage—signage that exists to increase motorist safety. Existing roadway signage is quite often clear and concise in meaning and message. These signs, however, lose their effectiveness when paired up against a distracted driver.

A 12" flashing beacon has been the tool of choice for the nation's roadways to emphasize a warning on a roadway sign since 1955. Indeed, the flashing pattern and height of these flash beacons might still work on some signs in certain locations. However, given the array of distractions now available to drivers, these traditional flashing beacons are simply too passive. Accordingly, disclosed herein is a beacon having a unique flashing sequence, and installation placement, that upon activation may command a driver's attention. As such, drivers are compelled to again look at a sign, understand its message, and respond.

As disclosed herein, a flashing beacon may include a signal unit, a control unit associated with the signal unit, a solar panel or collector, and an activation device that may all be mounted or otherwise positioned on a post of a roadway signpost. The activation device and solar panel may, however, also be positioned remotely from the post.

The signal unit may be rectangular in shape (although other shapes may be used) in order to decrease its obstructive profile relative to the sign, and it includes one or more flashable lights (e.g., LEDs) on the front, rear, bottom or side faces of the signal unit. One or more spotlights (e.g., LED spotlights) may also be positioned on the signal unit to illuminate an area (e.g., the street) in the vicinity of the signal unit. The signal unit may also include an audio transmission system and one or more displays (e.g., a LCD, plasma, or LEDs) to provide the user with information concerning the operation of the flashing beacon.

The control unit may include an electronic signal receiver (e.g., a radio receiver), a power supply, and control means for use in controlling the initiation and duration of the light assemblies of the flashing beacon.

The solar collector may include one or more solar cells that provide power to the unit during daylight hours and may also operate to recharge the power supply of the control unit so that the flashing beacon has adequate power during evening hours.

Finally, the activation device may include a pushbutton unit, signage, one or more counter displays, an infrared sensor, and a speaker system. Additional accessories for the activation device may also include devices such as a timer, microwave emitter, radio transmitter, step-pad, a pushbutton, infrared transmitter, wireless transmitter or like device. The signage associated with the pushbutton may also include a display (e.g., a LCD, plasma, or LEDs) to convey additional instructions to a pedestrian concerning operation of the flashing beacon and a counter to record the number of times the beacon has been activated. Finally, it will be appreciated that while the flashing beacon disclosed herein is discussed as being used in connection with a pedestrian crosswalk sign, it may also be used with any sign, placard or signal that uses a flashing signal (e.g., fire station sign, yield signs, dangerous curve signs, school speed zone signs, etc.).

BRIEF DESCRIPTION OF THE DRAWINGS

Reference will now be had to the attached drawings wherein like reference numerals refer to like parts throughout and wherein.

DESCRIPTION OF THE INVENTION

Figure 1:
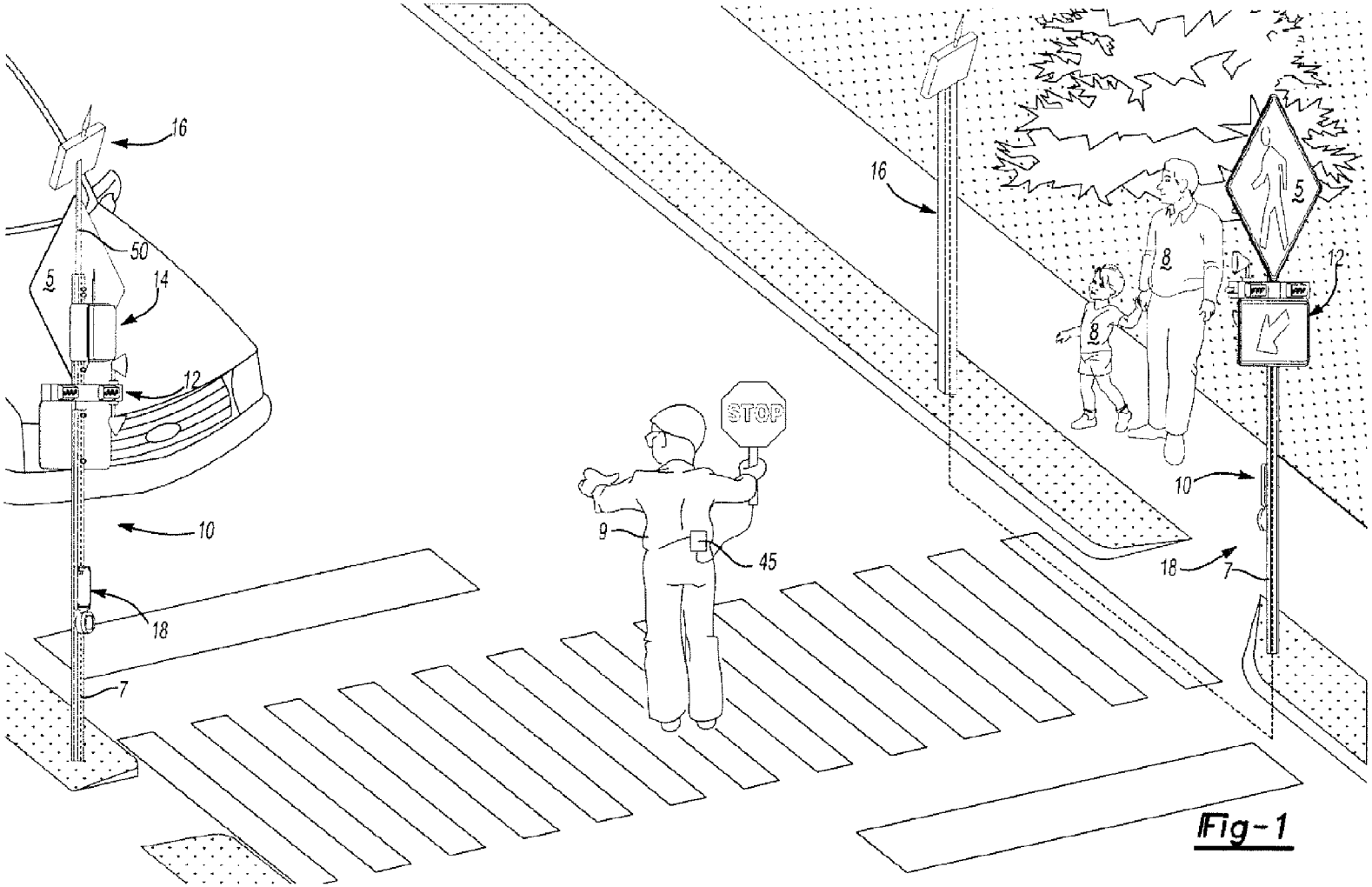
FIG. 1 is a environmental perspective view of a pair of flashing beacons constructed positioned on sign posts that are secured on opposite sides of a roadway, with one beacon having a remotely located solar cell and showing a crossing guard holding a stop sign with means to remotely activate the flashing beacons.

Referring now to FIGS. 1-10, a flashing beacon 10 for a sign(s) 5 may include a signal unit 12, a control unit 14, a solar collector 16, and an activation device 18 that may all be removably mounted to a post 7 of a sign 5. In operation, the flashing beacon 10 may provide a safer environment for drivers and pedestrians, particularly pedestrians attempting to traverse a busy street.

Figure 8:
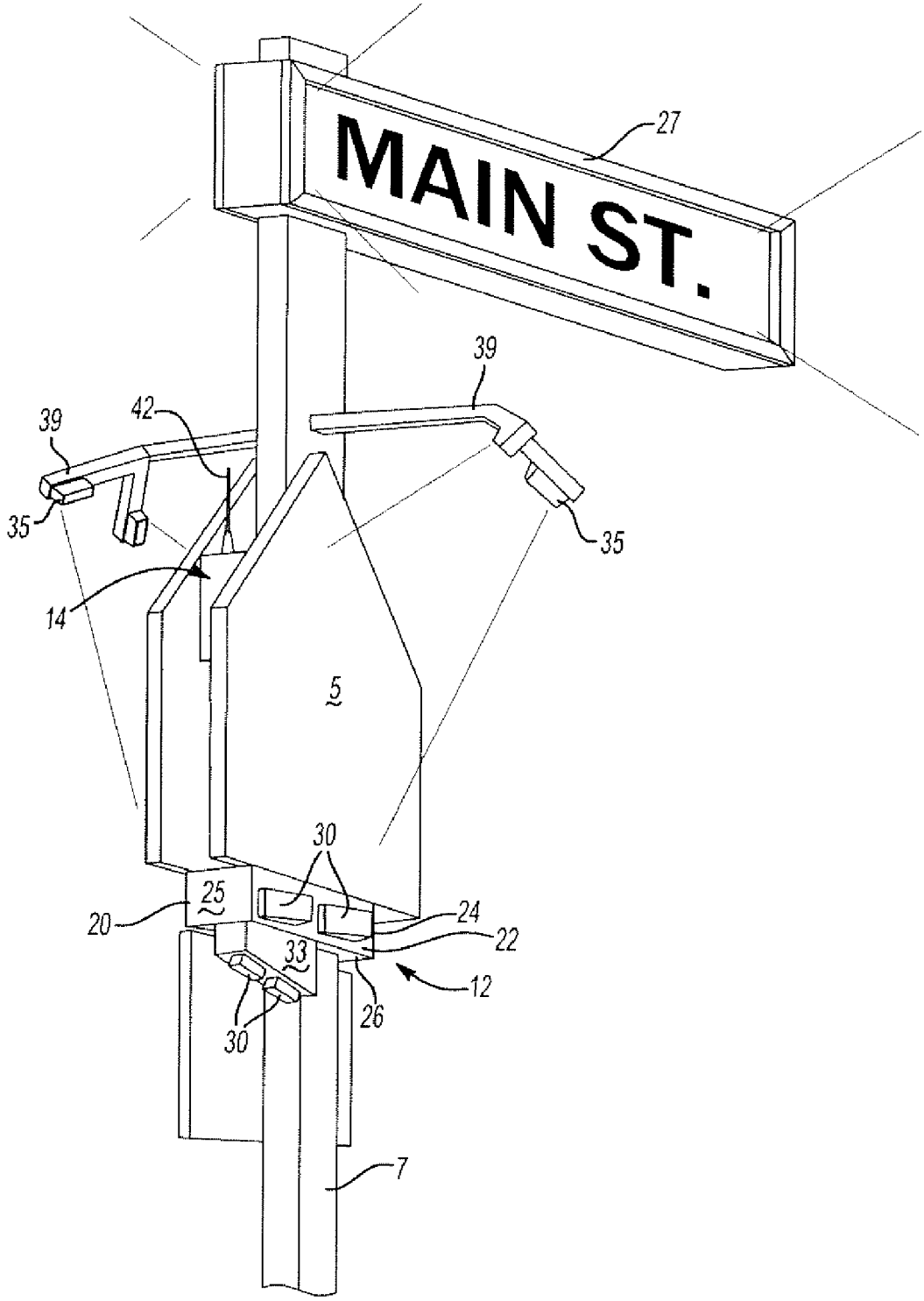
FIG. 8 is a side and rear perspective view of an embodiment of the flashing beacon showing, in particular, an illuminating street sign, sign illuminating spotlights, pivotable lights, and lights for illuminating the pavement proximate the flashing beacon.
Figure 9:
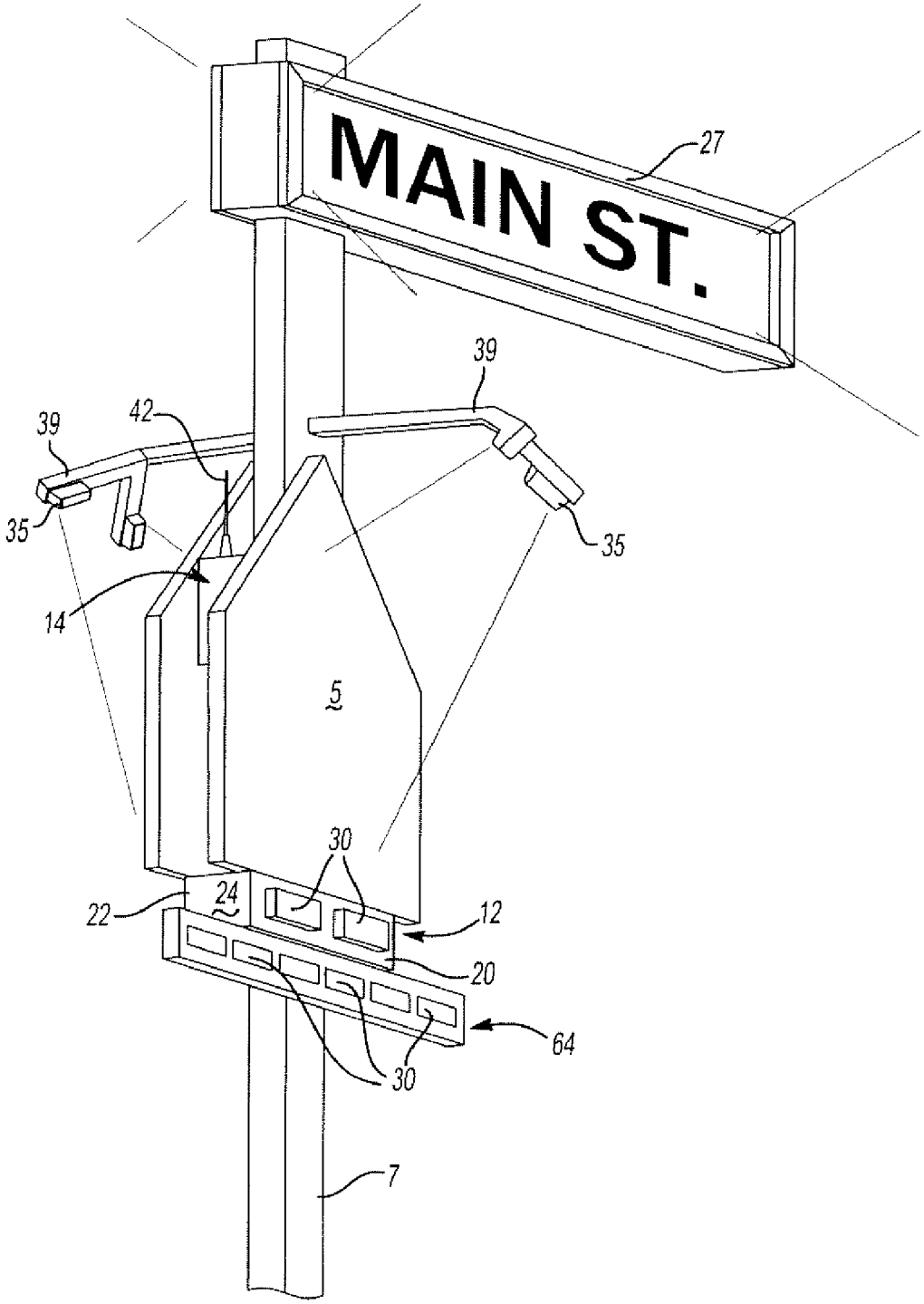
FIG. 9 is a side and front perspective view of an embodiment of the flashing beacon showing, in particular, an illuminating street sign, sign illuminating spotlights, pivotable lights, lights for illuminating the pavement proximate the flashing beacon and a light bar.
Figure 10:
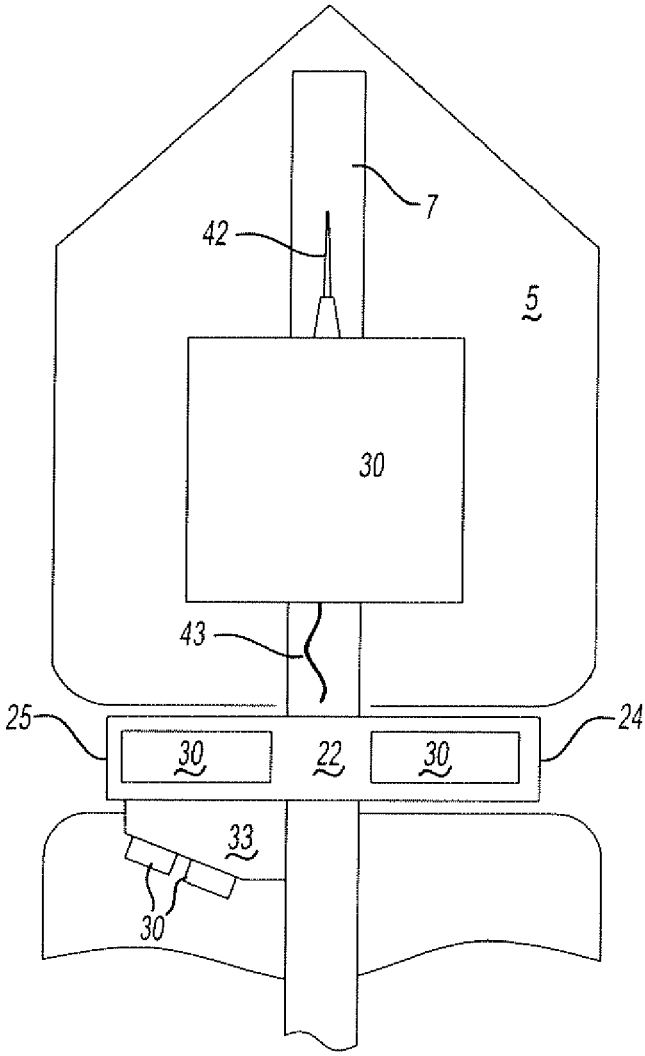
FIG. 10 is a rear view of an embodiment of the flash beacon showing, in particular, the radio signal receiving antennae.

Referring now to FIGS. 1-5, 8 and 9, the signal unit 12 may have an elongated, rectangular shaped body that may include a front face 20, a rear face 22, a pair of side faces 24, 25 and bottom face 26. A recess 28 may be defined in the front face 28 of the signal unit 12 such that the signal unit 12 may be positioned along the post 7 of the roadway sign 5. One or more light units 30 may be positioned on, or alternatively recessed within (see e.g., FIG. 8), each of the front face 20, the rear face 22, the side faces 24, 25 and the bottom face 26 of the signal unit 12. As shown in FIGS. 8 and 9, one or more illuminated street signs 27 may also be associated with each flashing beacon 10 and mounted by mounting each sign on the post of the sign 5. Further, as shown in FIG. 1, the signal unit 12 may be positioned on the sign post 7 immediately below the sign 5 so that, in a typically configuration, the light units 30 of the signal unit 12 are approximately the same distance above ground level as a traditional police cruiser. It is appreciated that a lighting array at such a height may receive greater recognition from a vehicle operator who might otherwise be "trained" to slow his or her vehicle when encountering flashing lights at this height.

Figure 11:
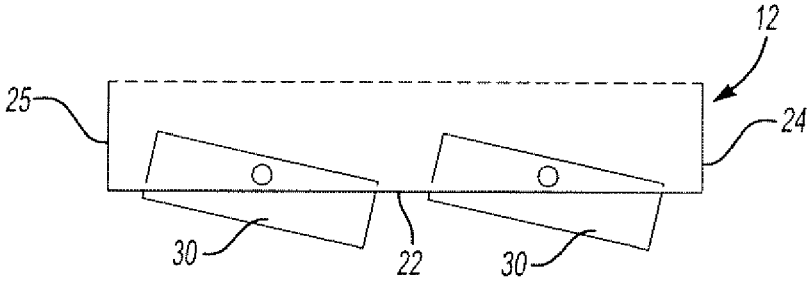
FIG. 11 is a top planar view of a signal unit of the flashing beacon showing the pivotable lights on the signal unit.

Referring to FIGS. 1-5, 8-11, and as best shown in FIG. 1, during operation of the flashing beacon 10 the light units 30 of the front face 20 of the signal unit 12 may be illuminated to alert oncoming vehicle traffic that a pedestrian(s) 8 has or is about to enter a crosswalk. Light units 30 on the rear face 22 may also be illuminated concurrently with the light units 30 of the front face 20 to alert vehicle traffic traveling in the opposing direction. Accordingly, it will be appreciated that where at least one flashing beacon 10 is positioned on each side of a roadway (or, e.g., on at least one side and in a center median), a vehicle will be alerted to the presence of a pedestrian(s) in an approaching crosswalk regardless of the vehicle's direction of travel. Further, as shown in FIGS. 8 and 11, the light units 30 on the rear face 22 of the signal unit 12 may be pivotably mounted to the signal unit 12 so that (during setup) each light unit 30 may be precisely aimed at oncoming traffic.

Still referring to FIGS. 1-5, 8 and 9, in addition to the light units 30 associated with the front 20 and rear 22 face of the signal unit 12, the light units 30 of each side face 24, 25 of the signal unit 12 may be illuminated to alert the pedestrian(s) 8 and/or crossing guard(s) 9 using the flashing beacon 10 that the light units 30 on the front 20 and rear 22 face of the signal unit 12 been activated. As such, by observing the illumination of a light unit 30 on a side face 24, 25 of a signal unit 12, a pedestrian 8 or crossing guard 9 on one side of a roadway may easily confirm that the light units 30 on front 20 and rear 22 faces on a signal unit 12 on the opposite side of the roadway have also been activated.

Still referring to FIGS. 1-5, 8 and 9, in addition to the light units 30 on the front 20, rear 22, and side 24, 25 faces of a signal unit 12, each signal unit 12 may also include lighting for illuminating the area proximate base of the post 7, including at least a portion of a nearby roadway. For example, one or more light units 30 may be positioned on the bottom face 26 of the signal unit 12. Further, as shown in FIGS. 1-5, the signal unit 12 may also one or more spotlights 32 (e.g., LED spotlights) that extend from the signal unit 12. As shown in FIGS. 8 and 9, the spotlights 32 may be constructed as lighting pods 33 that are mounted to the bottom face 26 of the signal unit 12. Each lighting pod 33 may include one or more LED lights. The lighting pods 33 may also be mounted to a signal unit 12 so that any light emitting from the pod 33 is projected directly downward or at a predetermined angle relative to the post 7. Further, as shown in FIGS. 8 and 9, one or more spotlights 35 may be used to illuminate the face of a sign 5. Specifically, the spotlights 35 may be positioned on stanchions 39 that extend from the post 7.

Referring again to FIGS. 1-5, 8 and 9, as mentioned above the light units 30, spotlights 32 and other light units of the flashing beacon 10 may each include one or more light emitting diodes ("LEDs"). For example, LEDs of the type manufactured by Whelan Engineering Inc. may be used in connection with the light units 30 and spotlights 32 of flashing beacon 10. However, it will be appreciated that other types of lights may also be used with the flashing beacon 10.

The one or more of the lights of the light units 30 (i.e., the light units 30 on the bottom face 26) may function to be continuously illuminated during operation of the flashing beacon 10. However, as mentioned above, the light units 30 of the flashing beacon 10 may also function to flash according to uniform regulations at a rate of 50-60 cycles per minute, at an increased rate of 60-110 cycles per minute, or at any other rate predetermined by the user. The light units 30 may further be arranged such that they flash in a predetermined pattern such as a wavy line or a so-called wig-wag flashing pattern as will be described below.

Figure 5:
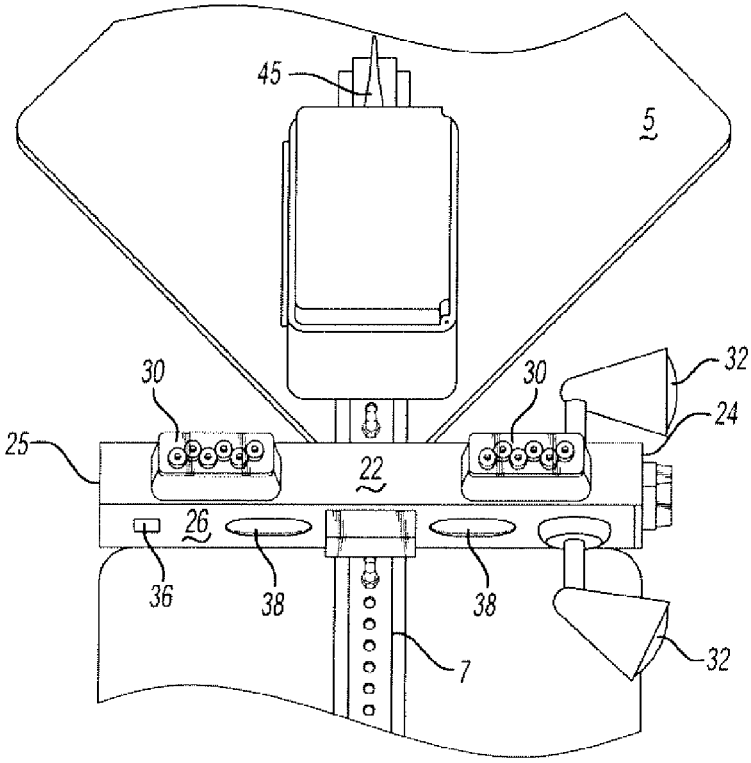
FIG. 5 is a rear perspective view of an embodiment of a flashing beacon constructed in accordance with the present invention that includes a view of the bottom face or underside of the signal unit of the flashing beacon.
Figure 6:
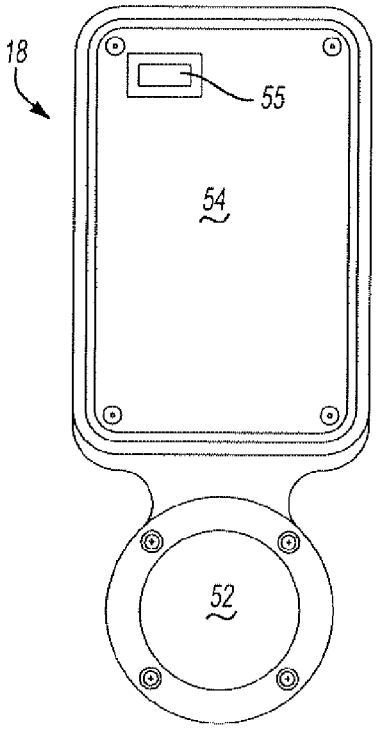
FIG. 6 is a front planar view of an embodiment of a pushbutton apparatus that may be used in connection with the flashing beacon.

Referring now to FIG. 5, the signal unit 12 may also include a programmable audio unit and a voltage meter display 36. The voltage meter display 36 (which may also be positioned in the control unit 14) may include an LCD, plasma screen monitor or an arrangement of LEDs positioned on the bottom face 26 of the signal unit 12 that may be in electrical communication with a power supply (i.e., a battery—not shown) of the control unit 14 (as discussed below) or another battery (not shown) that may be positioned in the signal unit 12. An audio unit (which may also be incorporated into the activation device 18) may include audio transmission apparatus that includes at least one speaker 38 and a memory means (e.g., an erasable/programmable memory). The memory means (not shown) may permit an administrator of the flashing beacon 10 to program and/or change an audio message that is broadcast to a user of the beacon 10.

Referring again to FIGS. 1-5, 8 and 9, the control unit 14 of the flashing beacon 10 may include one or more electronic signal receivers (i.e., a radio or wireless receiver) including an antennae 42, 43, a power supply (i.e., a battery), and control means (i.e., an erasable programmable memory (not shown)) for use in controlling activation of the light units 30 and spotlights 32 of the signal unit 12.

In operation, the control unit 14 may be used to selectively activate and deactivate the various lights of the flashing beacon 10. For example, a school principal, crossing guard 9 (see FIG. 1), or public safety official may use a remote transmitter to activate, program or otherwise control the activation of the flashing beacon 10 by transmitting an appropriate signal to the signal receiver of the control unit 14. More specifically, as shown in FIG. 1, the crossing guard 9 may carry with him or her a personal flash beacon system 45 such as the Personal Defender™ or Crosswalk Defender™ manufactured by Stop Experts, Inc. of Venice, Fla. These personal flash beacon systems may include a radio transmitter that when activated results in the activation of the lights of the Bashing beacon 10 and when deactivated results in the deactivation of the lights of the flashing beacon.

Referring now to FIGS. 1-4, the solar collector 16 may include a panel of one or more solar cells 48. The panel 16 may be positioned on arm 50 that extends above the sign from the control unit 16, or that is otherwise mounted to the post 7 of the sign 5. Further, as shown in FIG. 1, in those instances where the overhead tree cover may prevent sufficient exposure of the solar collector to direct sunlight, the solar collector 16 may be positioned a predetermined distance away from the flashing beacon 10 and electrically connected to the beacon 10 by means of underground electrical wire and conduit. It will be appreciated that the solar collector 16 may be used as a clean power source for the signal unit 12 and the control 14 of the flashing beacon 10 during daylight hours. It may also be appreciated that the solar collector 16 may communicate with the power supply of the control unit 14 to thereby provide power to the flashing beacon 14 during evening hours.

Referring now to FIGS. 1-4, 6 and 7, the activation device 18 may include a pushbutton 52 in electrical, wireless or radio communication with the control unit and/or the signal unit, and one or more placards 54 that may convey additional information concerning operation of the flashing beacon 10. Pushing the pushbutton 52 may activate that flashing beacon 10. However, it should also be appreciated that other devices such as a timer, microwave emitter, radio transmitter, step-pad, internal activation means, a timer, a pushbutton, infrared transmitter, wireless transmitter or like device. For example, the activation device may include an infrared sensor 57 that may detect the presence of an individual within a predetermined range (e.g., 5 feet) from the device 18 and respond by activation of the flashing beacon 10.

Figure 7:
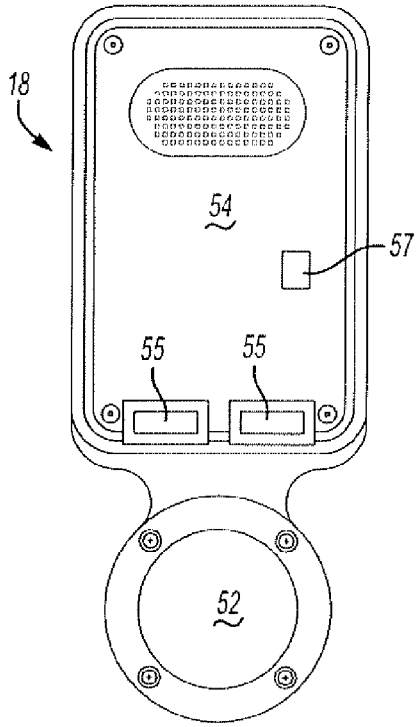
FIG. 7 is a front planar view of another embodiment of a pushbutton apparatus that may be used in connection with the flashing beacon.

Still referring to FIGS. 1-4, 6 and 7, one or more displays 55 (e.g., LCD, plasma screen monitor, or LEDs) may also be positioned on the activation device 18 to provide a user with an additional instructional message. For example, as shown in FIG. 7, the activation device may include a pair of displays 55 that indicate the number of time the flashing beacon has been activated during daylight hours (right side) and after dark (left side). Likewise, as mentioned above, the activation device 18 may include memory means and an associated speaker system capable for providing a user with an audible instructional message.

Figure 2:
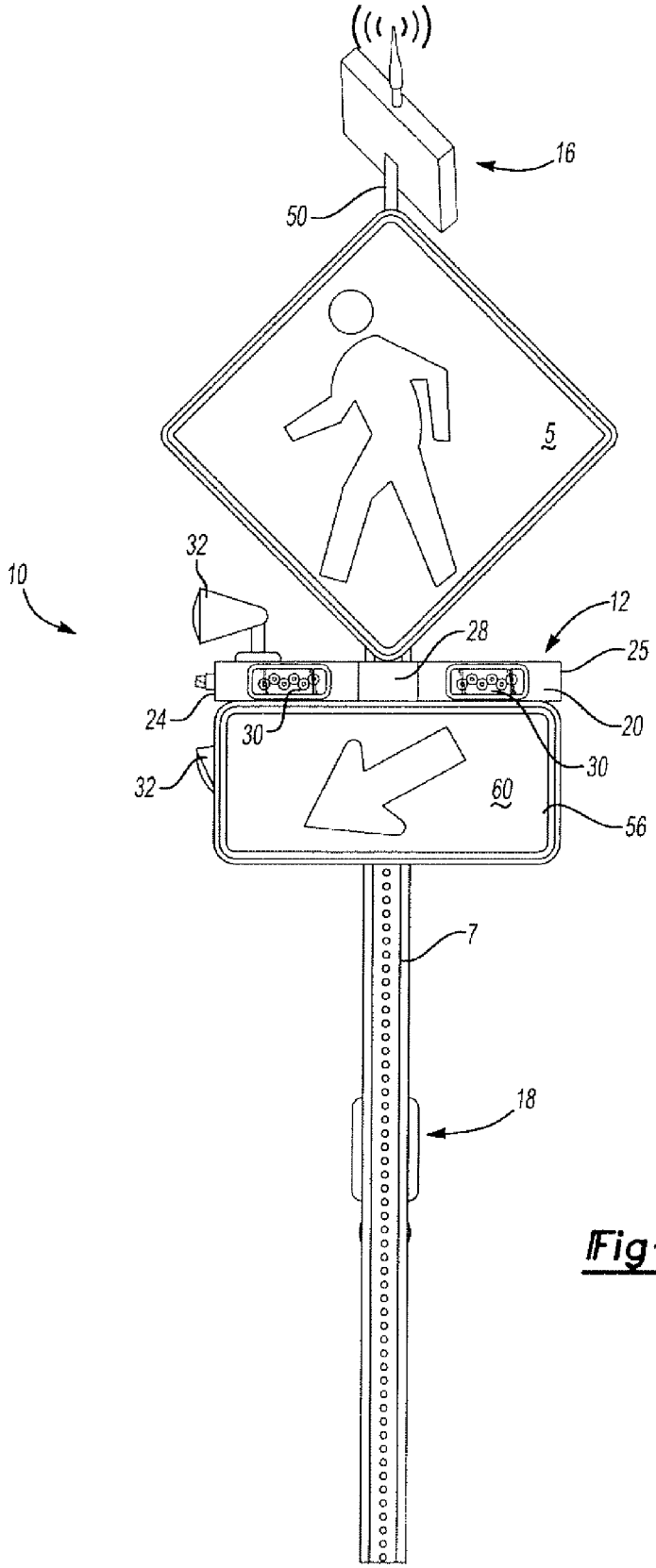
FIG. 2 is a front planar view of an embodiment of a flashing beacon wherein the double-sign unit is in a first or retracted position.
Figure 3:
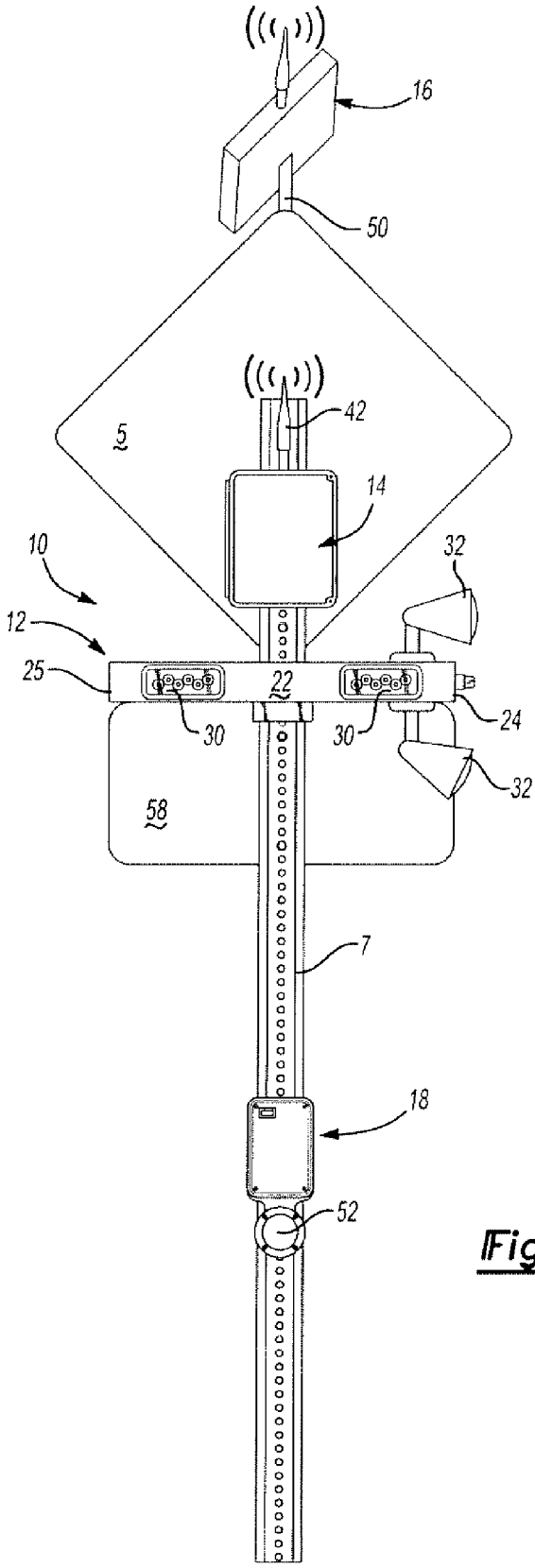
FIG. 3 is a rear planar view of an embodiment of a flashing beacon.
Figure 4:
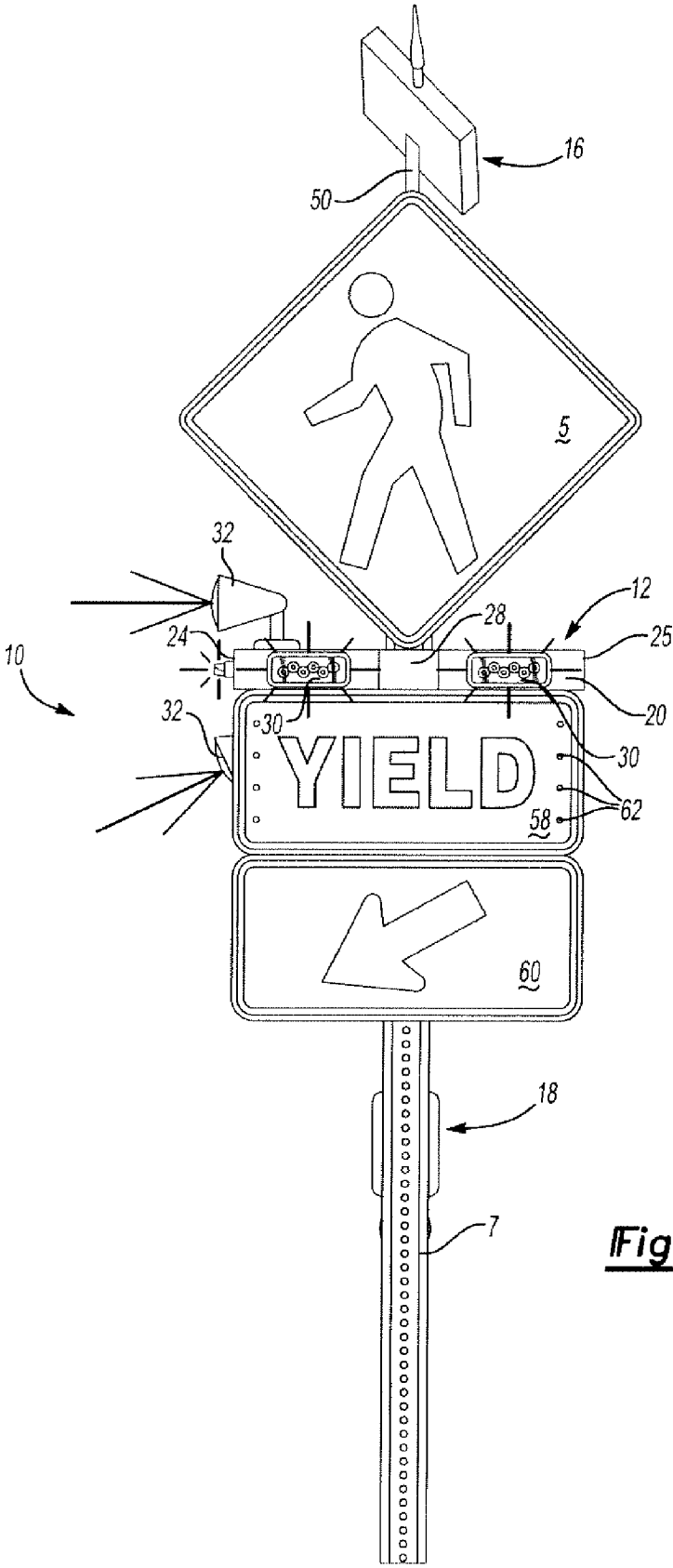
FIG. 4 is a front planar view of an embodiment of a flashing beacon wherein the double-sign unit is in a second or extended position.

Referring now to FIGS. 1-3, the flashing beacon 10 may also include a double-sign unit 56. As shown in FIG. 2, the double-sign unit 56 may include a first sign placard 58 and a second sign placard 60 that is movable relative to the first sign placard 58. Prior to activation of the flashing beacon 10, the second sign placard 60 may be positioned in front of the first sign placard 58. However, upon activation of the flashing beacon 10, the second sign placard 60 may be translated or otherwise shifted to a second position to thereby reveal the first sign placard 58. Further, the first sign placard may include one or more LEDs 62 to thereby illuminate the first sign placard.

Referring now to FIG. 9, a light bar 64 that may include one or more light units 30 may be positioned on the signpost 7 below the signal unit 12. Alternatively, the light bar 64 may be positioned above the signal unit 12 or between the light unit 30 on the front face 20 of the signal unit 12. In operation, the light bar 64 functions to quickly "flash" any oncoming vehicles. Typically, this flash may about 1½ to 2 seconds after any lights on the front 20, rear 22, or side 24, 25 faces of the signal unit 12 had been activated. The advantage of this "flash" (in addition to the normal illumination of the flashing beacon) is that a vehicle that is already within a predetermined distance from the flashing beacon 10 may not see the flash because, in many instances, the vehicle will have already driven past the beacon 10 given the 2 second delay period. However, vehicles that were beyond the predetermined distance when the flashing beacon 12 was activated will encounter not only the normal illumination of the flashing beacon, but also the secondary "flash" of the light bar 64. As such, the secondary flash functions as a further reminder to the driver to heed the commands of the associated sign 5.

In preliminary testing of the flashing beacon disclosed herein, Applicant has achieved significant improvement over the traditional flash beacon systems known in the art.

Example 1

A study of percent of vehicle responses to 70 pedestrian crossings comparing a traditional (MUTCD Standard) flashing beacon with dual side mounted lights (top row) against Applicant's flashing beacon with dual flashing overhead lights with a "wig-wag" flashing pattern (bottom row) in the City of St. Petersburg, Fla. at 31$^{st}$ Street north of 54$^{th}$ Avenue South. A wig-wag pattern is described as follows: Where the front face 20 of the signal unit 12 of the flashing beacon 10 being tested included two side-by-side LED lights, each wig-wag, cycle including two flashes (adjustable) of one light and, simultaneously, three flashes (adjustable) of the other tight. The speed of the left and right flashes is adjusted so that the cycle time for the three flashes for the other light is equal to the cycle time for the two flashes. Each flash beacon tested was set up to function at a rate of 76 wig-wag cycles per 30 seconds (for a total of 190 total flashes).

| BASE | | 7-days | | 30-days | |
|---|---|---|---|---|---|
| N/B-W/B | S/B-E/B | N/B-W/B | S/B-E/B | N/B-W/B | S/B-E/B |
| 0.00% | 4.03% | 3.74% | 2.33% | 19.51% | 7.89% |
| 0.00% | 4.03% | 58.54% | 48.72% | 82.76% | 69.44% |

Example 2

A study of percent of vehicle response to 70 pedestrian crossings comparing traditional (MUTCD Standard) flashing beacon with dual side mounted lights (top row) against Applicant's flashing beacon, using a wig-wag pattern, placed in a four-lane divided highway with median (bottom row) in the City of St. Petersburg, Fla. at 4$^{th}$ Street and 18$^{th}$ Avenue South.

| BASE | | 7-days | | 30-days | |
|---|---|---|---|---|---|
| N/B-W/B | S/B-E/B | N/B-W/B | S/B-E/B | N/B-W/B | S/B-E/B |
| 0.00% | 0.00% | 12.24% | 12.09% | 14.50% | 19.51% |
| 0.00% | 4.03% | 58.54% | 48.72% | 82.76% | 69.44% |

Having thus described my invention, various other embodiments will become known to those of skill in the art that do not depart from the spirit of the present invention.

I claim:

1. A flashing beacon in combination with a roadway sign, the combination comprising:

a signpost;

a sign secured to the signpost;

a signal unit positioned on the signpost and spaced apart from the sign, the signal unit including a front face, a rear face and a pair of end faces;

at least two light units mounted to the front face and at least one light unit mounted to an end face, of the signal unit, the at least two light units on the front face operating to emit a wig-wag flash pattern, the pattern including emitting within a predetermined time two light flashes from one light unit and three light flashes from the other light unit;

a control unit positioned on the signpost and in electronic communication with the signal unit;

a solar collector in electrical communication with the control unit; and an activation device positioned on the signpost in communication with the control unit and operating to activate the signal unit.

2. The flashing beacon of claim 1 wherein the signal unit includes at least one light unit mounted to the rear face.

3. The flashing beacon of claim 2, wherein the light unit on the rear face of said signal unit is mounted for pivotable movement relative to said rear face.

4. The flashing beacon of claim 2, further comprising a personal flashing beacon system positioned remote from the signpost, having a transmitter in communication with the control unit and being operable to selectively activate and deactivate the light units of the flashing beacon.

5. The flashing beacon for claim 1, wherein the signal unit is positioned on the signpost below the sign.

6. The flashing beacon of claim 1, wherein the solar collector is positioned on a frame operable to be positioned on one of the ground or a support structure, and at a location that is remote of a location of the signpost.

7. The flashing beacon of claim 1, further comprising a light bar position on the signpost remote from the sign.

8. The flashing beacon of claim 1, further comprising a double-sign unit having a first sign placard and a second sign placard, the second sign placard being movable positioned in front of the first sign placard.

9. The flashing beacon of claim 1 further comprising a spotlight extending from the signal unit and operating to illuminate an area proximate a base of the signpost.

10. A flashing beacon comprising:

a signal unit having a front face and a rear face and a pair of end faces;

at least two light units mounted to the front face and at least one light unit mounted to at least one end face of the signal unit, the at least two light units on the front face operating to emit a wig-wag flash pattern, the pattern including emitting within a predetermined time two light flashes from one light unit and three light flashes from the other light unit;

a light bar having a plurality of light units, the light bar being positioned remote from a face of the signal unit;

a control unit in electronic communication with the signal unit and the light bar;

a solar collector in electrical communication with the control unit; and an activation device in communication with the control unit and operating to activate the signal unit.

11. The flashing beacon of claim 10, further comprising a personal flashing beacon system positioned remote from the signpost, having a transmitter in communication with the control unit and being operable to selectively activate and deactivate the light units of the flashing beacon.

12. The flashing beacon of claim 10, wherein the solar collector is positioned remote from signpost.

13. The flashing beacon of claim 10, further comprising a double-sign unit having a first sign placard and a second sign placard, the second sign placard being movably positioned in front of the first sign placard.

14. A method for slowing vehicle traffic comprising:

providing a flashing beacon having a signpost, a sign secured to the signpost, a first and a second light unit, with each light supported by the signpost, a control unit in electronic communication with each light unit; and a solar collector supported by the signpost and operable to supply power to the beacon;

positioning the flashing beacon proximate a roadway so that each light unit is visible to oncoming traffic; and switching the light units on and off to generate a wig-wag flash pattern, the pattern including emitting within a predetermined time two light flashes from one light unit and three light flashes from the other light unit.

15. The method of claim 14 further comprising:

providing a transmitter in communication with the control unit;

providing a receiver supported by the sign post and communicating with the control unit; and transmitting a signal from the transmitter to the receiver to selectively activate the light units.

16. The flashing beacon of claim 5, further comprising a second sign secured to the signpost below said sign and below said signal unit.

17. The flashing beacon of claim 14 further comprising a downwardly directed light supported by the signpost and illuminating an area proximate a base of the signpost.

18. A flashing beacon kit comprising:

a signal unit configured to be mounted to a signpost, the signal unit having a front face and a rear face and a pair of end faces, the signal unit also including at least two lights units mounted to the front face of the signal unit, and at least one light unit mounted to an end face of the signal unit, and the signal unit being configured to generate a wig-wag flash pattern, the pattern including emitting within a predetermined time two light flashes from one light unit on the front face and three light flashes from the other light unit on the front face;

a control unit in electronic communication with the signal unit;

a solar collector in electrical communication with the control unit; and an activation device in communication with the control unit and operating to activate the signal unit.

* * * * *